US008956579B2

(12) United States Patent
Yankee et al.

(10) Patent No.: US 8,956,579 B2
(45) Date of Patent: Feb. 17, 2015

(54) CONTROL FOR DISPENSING SYSTEM

(75) Inventors: Wayne Yankee, San Jose, CA (US); David Howland, Aptos, CA (US); Scott Christa, Santa Cruz, CA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 438 days.

(21) Appl. No.: 12/435,051

(22) Filed: May 4, 2009

(65) Prior Publication Data

US 2009/0276101 A1 Nov. 5, 2009

Related U.S. Application Data

(60) Provisional application No. 61/050,340, filed on May 5, 2008.

(51) Int. Cl.

| | |
|---|---|
| ***B01L 3/02*** | (2006.01) |
| ***D06F 39/02*** | (2006.01) |
| ***A47L 15/44*** | (2006.01) |

(52) U.S. Cl.

CPC ..... *D06F 39/022* (2013.01); *A47L 15/4418* (2013.01)

USPC ..... 422/509; 422/501; 422/510

(58) Field of Classification Search

USPC ..... 422/501, 509, 510; 702/19–22, 31

See application file for complete search history.

(56) References Cited

U.S. PATENT DOCUMENTS

| | | | | |
|---|---|---|---|---|
| 5,390,385 | A | 2/1995 | Beldham | |
| 6,325,286 | B1 * | 12/2001 | Howland et al. | 235/381 |
| 6,377,868 | B1 * | 4/2002 | Gardner, Jr. | 700/236 |
| 2001/0049846 | A1 * | 12/2001 | Guzzi et al. | 8/158 |
| 2004/0143368 | A1 * | 7/2004 | May et al. | 700/241 |
| 2006/0113322 | A1 | 6/2006 | Maser et al. | |
| 2007/0118862 | A1 | 5/2007 | Jeong et al. | |
| 2009/0221059 | A1 * | 9/2009 | Williams et al. | 435/287.2 |

OTHER PUBLICATIONS

Patent Cooperation Treaty, International Search Report, PCT/US2009/042694, Jun. 29, 2009.

BrightLogic Computer Software, Revolutionary Dispensing Solutions, 20 pages, www.brightwell.co.uk, Brightwell Dispensers Ltd., East Sussex, U.K., Jul. 14, 2009.

Laundry Systems BrightLogic, Revolutionary Dispensing Solutions, 44 pages, Brightwell Dispensers Ltd., East Sussex, U.K., Mar. 19, 2010.

Computer Software & USB, Revolutionary Dispensing Solutions, 2 pages.

* cited by examiner

*Primary Examiner* — Jill Warden
*Assistant Examiner* — Dwayne K Handy
(74) *Attorney, Agent, or Firm* — Wood, Herron & Evans, LLP

(57) ABSTRACT

A chemical dispensing system is provided having a micro-controller and at least one expansion module. The expansion module includes an expansion module interface. The expansion module is in communication with the micro-controller via the expansion module interface. The at least one expansion module expands capabilities of the chemical dispensing system beyond a base operation of the device.

24 Claims, 4 Drawing Sheets

CONTROL FOR DISPENSING SYSTEM

CROSS-REFERENCE TO RELATED APPLICATIONS

This application claims priority to U.S. Provisional Application Ser. No. 61/050,340, filed on 5 May 2008 and entitled CONTROL FOR DISPENSING SYSTEM, the disclosure of which is hereby incorporated by reference in its entirety.

FIELD OF THE INVENTION

The invention relates generally to chemical dispensing systems for laundry, ware-wash, and healthcare, and more particularly to the transfer and input of data related to the operation of the chemical dispensing control.

BACKGROUND OF THE INVENTION

The dispensing of liquid chemical products from one or more chemical receptacles is a common requirement of many industries, such as the laundry, textile, ware wash, healthcare instruments, and food processing industries. For example, in an industrial laundry facility, one of several operating washing machines will require, from time to time, aqueous solutions containing quantities of alkaloid, detergent, bleach, starch, softener and/or sour.

Increasingly, such industries have turned to automated methods and apparatus systems for dispensing chemical products. Such automated methods and apparatus systems provide increased control of product use and minimize human contact with potentially hazardous chemicals.

Contemporary automatic chemical dispensing systems used in industry require pumps for the liquid chemical products. Generally, these pumps deliver raw chemical product directly to a machine for use or to a dilution manifold or container where the chemical product is mixed with a diluent, typically water. Such systems are relatively simple in concept, but they can be expensive to build and operate. A number of methods for the control of dispensing chemicals have been developed and employed and are well known in the art. Each method generally utilizes techniques that require a means of input, typically through direct user interface or connectivity to a host device, e.g. Personal Computer (PC), not always available in the immediate environment, and provides limited features and capabilities through "out-of-the-box versions" of the devices. This is usually accomplished with a micro-controller built into the dispensing system or as an integral portion of the system. While these systems expand the capabilities of the dispensing systems, they are also limited in scope and are difficult to update with additional or new features and capabilities. Additionally, other more specialized modules may require specialized connections and/or complicated wiring in order to be used with contemporary dispensing systems.

It is therefore desirable to have the ability to move data to and from, or connect additional devices to an intelligent dispensing system.

SUMMARY OF THE INVENTION

A chemical dispensing system is provided including a micro-controller and at least one expansion module. The expansion module has an expansion module interface for communicating with the micro-controller or other components of the chemical dispensing system. The expansion module is in communication with the components of the chemical dispensing system via the expansion module interface. The expansion module expands the capabilities of the chemical dispensing system beyond a base operation of the system.

In some embodiments, the expansion module interface includes a uni-directional communication link, while in other embodiments the expansion module interface includes a bi-directional communication link. In some embodiments, the micro-controller includes at least one USB port. In these embodiments, the USB port may be used for the communication between an expansion module and the micro-controller.

In some embodiments, the expansion module interface may be a data storage device. In a particular embodiment having the data storage device, a USB port may be used to read and write chemical dispensing program files. The chemical dispensing program files may be used to automatically configure the chemical dispensing system. Additionally, the USB port may be used to write chemical dispensing activity reports.

In some embodiments, the chemical dispensing system includes a computer in communication with the micro-controller. In these embodiments, data may be transferred between the computer and the micro-controller. The data may include: a chemical dispensing program, a single program parameter, activity reports, a single activity report, or combinations thereof. The chemical dispensing system may be configured to include application software for execution on the computer, where the application software may be designed to generate data used for automatically configuring the chemical dispensing system.

In other embodiments including a computer, the micro controller may be reprogrammed using a local connection with the computer. In still other embodiments including a computer, the micro controller may be reprogrammed using a remote connection with the computer. In some embodiments, the expansion module may provide wireless communication to a machine interface, a pump interface, a machine, additional expansion modules, a computer, or a computer network.

A method for controlling a chemical dispensing system is also provided. The method includes establishing communication between a micro-controller and an expansion module having an expansion module interface. The capabilities of the chemical dispensing system are expanded beyond a base operation using at least one expansion module.

In some embodiments, communication between the micro-controller and the expansion module may be established using at least one USB port. Chemical dispensing program files may be read using the USB. Additionally, chemical dispensing program files may be written using the USB. The chemical dispensing system may be automatically configured using the chemical dispensing program files. In some embodiments, wireless communications may be provided using the expansion module to a machine interface, a pump interface, a machine, additional expansion modules, a computer, or a computer network.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention addresses limited input/output methods, thus providing improved efficiency and improved programming, as well as a means for expansion of features and expansion of capabilities. Technology embedded within the micro-controller of the system may provide the capability of direct bi-directional communication to multiple types of devices. The input/output of data can be accomplished via display of information on a screen associated with a micro-controller, through non-volatile memory devices, through computer devices, or through external modules that provide additional means, e.g. wireless communications, network connectivity, etc. This capability may enable an operator to more easily manage chemical programs, monitor chemical usage and/or dispenser activities, make adjustments in dispensing control, monitor system functions, or to increase the capabilities and features of the system without having to implement a new dispensing system itself.

Embodiments of the present invention address the need to replace equipment to provide additional features and capabilities, or the need to provide a feature-rich system that contains capabilities that are not fully utilized. This is accomplished by embedding technology within the micro-controller of the system, which allows for adding capabilities and features that are not contained within the base system. These capabilities and features can be increased through added modules that connect and utilize the bi-direction communication for a specific single-function or group of functions.

Figure 1:
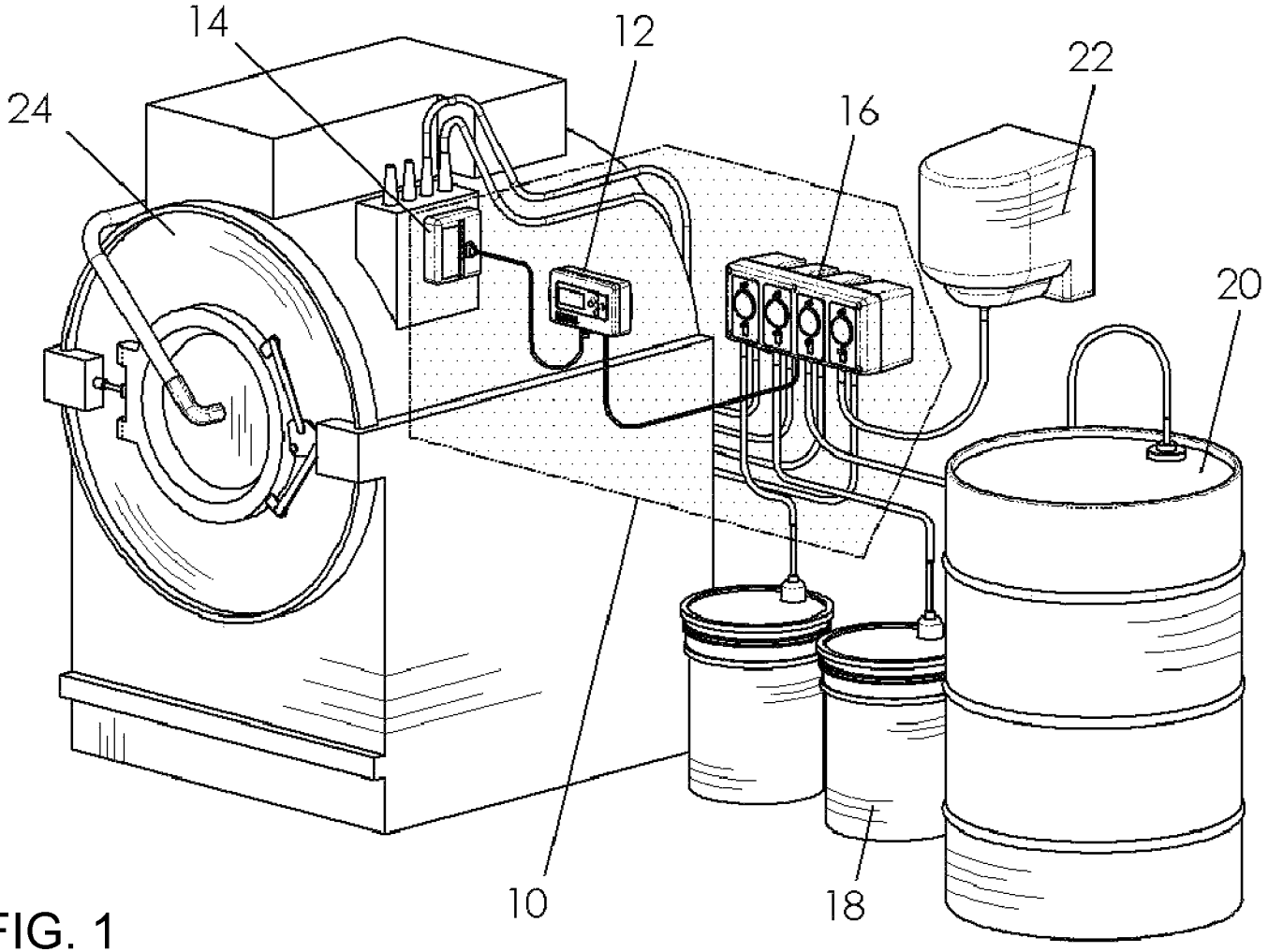
FIG. 1 is an illustration of an exemplary base dispensing system and its main components consistent with embodiments of the present invention.

Turning now to the drawings, FIG. 1 illustrates the structure of an exemplary chemical dispensing system 10. The base configuration of the chemical dispensing system 10 may contain a pump interface 16, a machine interface 14, and a micro-controller 12, which, through wiring and plumbing, connects to containers of chemicals and a machine. The micro-controller 12, may receive inputs from the machine interface 14 and send instructions to the pump interface 16. The pump interface 16 generally provides interfaces between various chemical storage units 18, 20, 22, a dilutent source 23 (FIG. 2) or a machine 24. Machines can vary from a laundry machine to a ware-wash machine to a healthcare wash. One skilled in the art will realize that the machine 24 may represent any type of a machine that uses dispensed chemicals.

Figure 2:
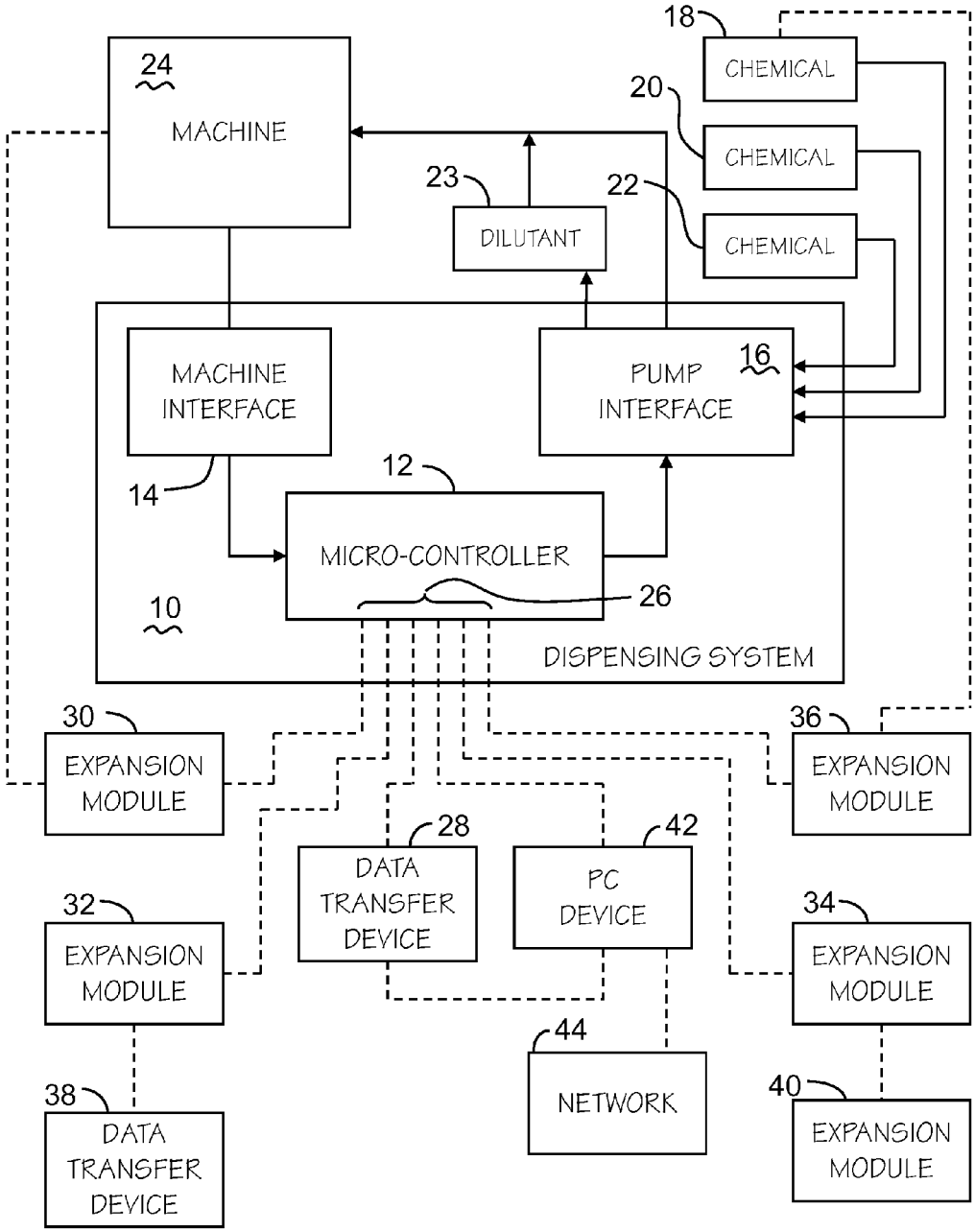
FIG. 2 is a block diagram of the exemplary dispensing of FIG. 1, including expansion modules.

As seen in the block diagram representation of the chemical dispensing system 10 in FIG. 2, the micro-controller 12 may also include interfaces 26 for data transfer devices 28 and expansion modules 30-36. Expansion modules 30-36 may also provide a means of data transfer and source upgrades. Expansion modules 30-36 may be limited to one specific feature or may be a bundle of features and capabilities. Expansion modules 30-36 may also provide additional interface to chemicals and equipment.

Figure 3:
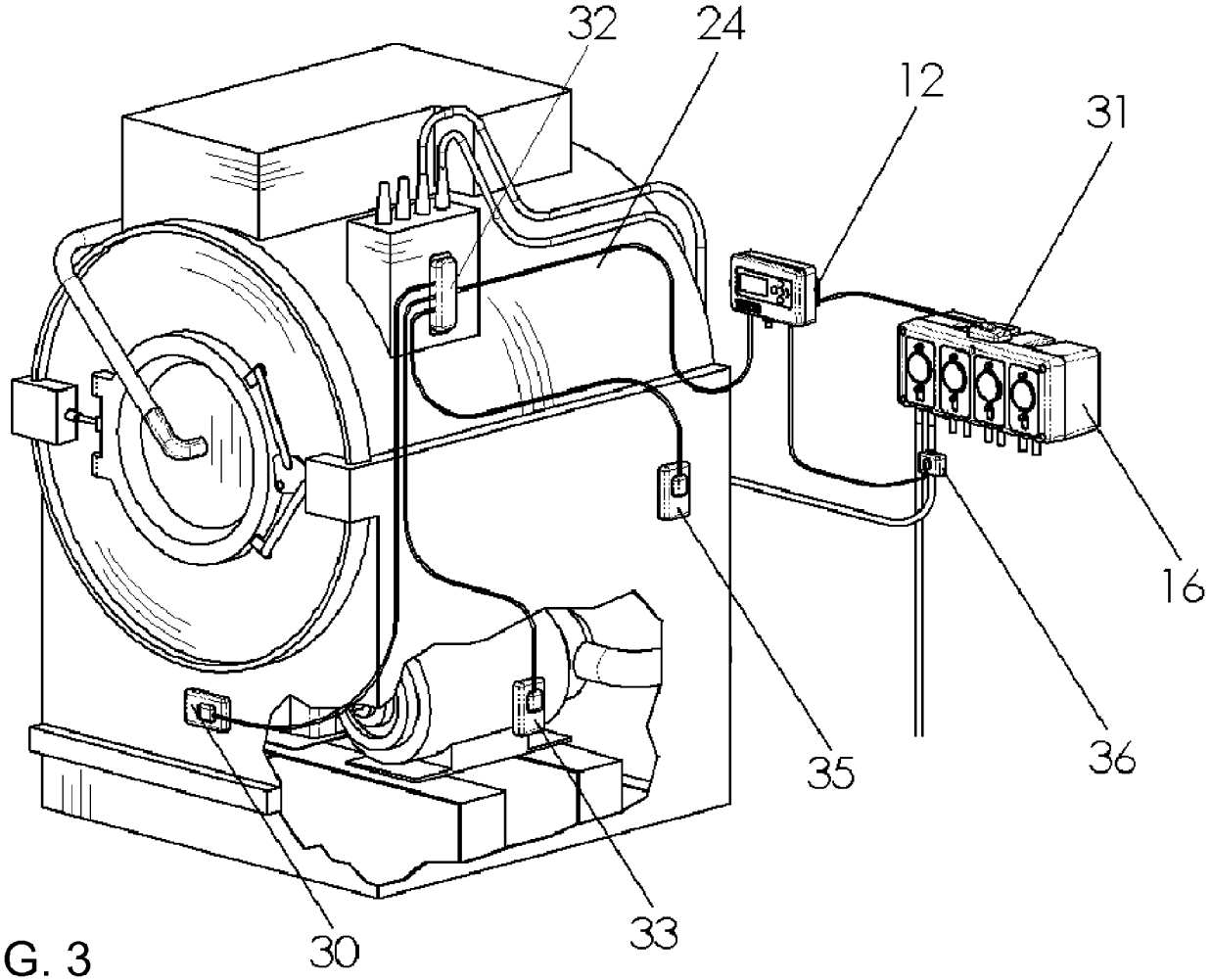
FIG. 3 is an illustration of one embodiment of the dispensing system of FIG. 2 with expanded capabilities through add-on devices.

As illustrated in FIG. 3, add-on devices may be connected to the micro-controller, pump interface or machine interface dependent upon where in the system the expanded capabilities are required or applied. For example, and as seen in FIGS. 2 and 3, some types of expansion units may include an expansion module 30, which may be a proof-of-clean module that would interface between the machine 24 and the micro-controller 12, or between the machine 24 and the machine interface 14, or between an expansion module 36 and the pump interface 16, and be used to monitor functions such as water temperature or chemicals dispensed and communicate this information back to the micro-controller 12. Another expansion unit 32 may include interfaces to additional data transfer units 38, such as the data storage devices as discussed above, network hardware 44 to connect to local area networks (LAN), wide area networks (WAN), or the Internet (TCP/IP). Data transfer device 38 may also include cellular or other modems allowing users to connect remotely to the micro-controller and the dispensing system. Other expansion modules 34 may be a hub to which additional expansion modules 40 attach.

Figure 4:
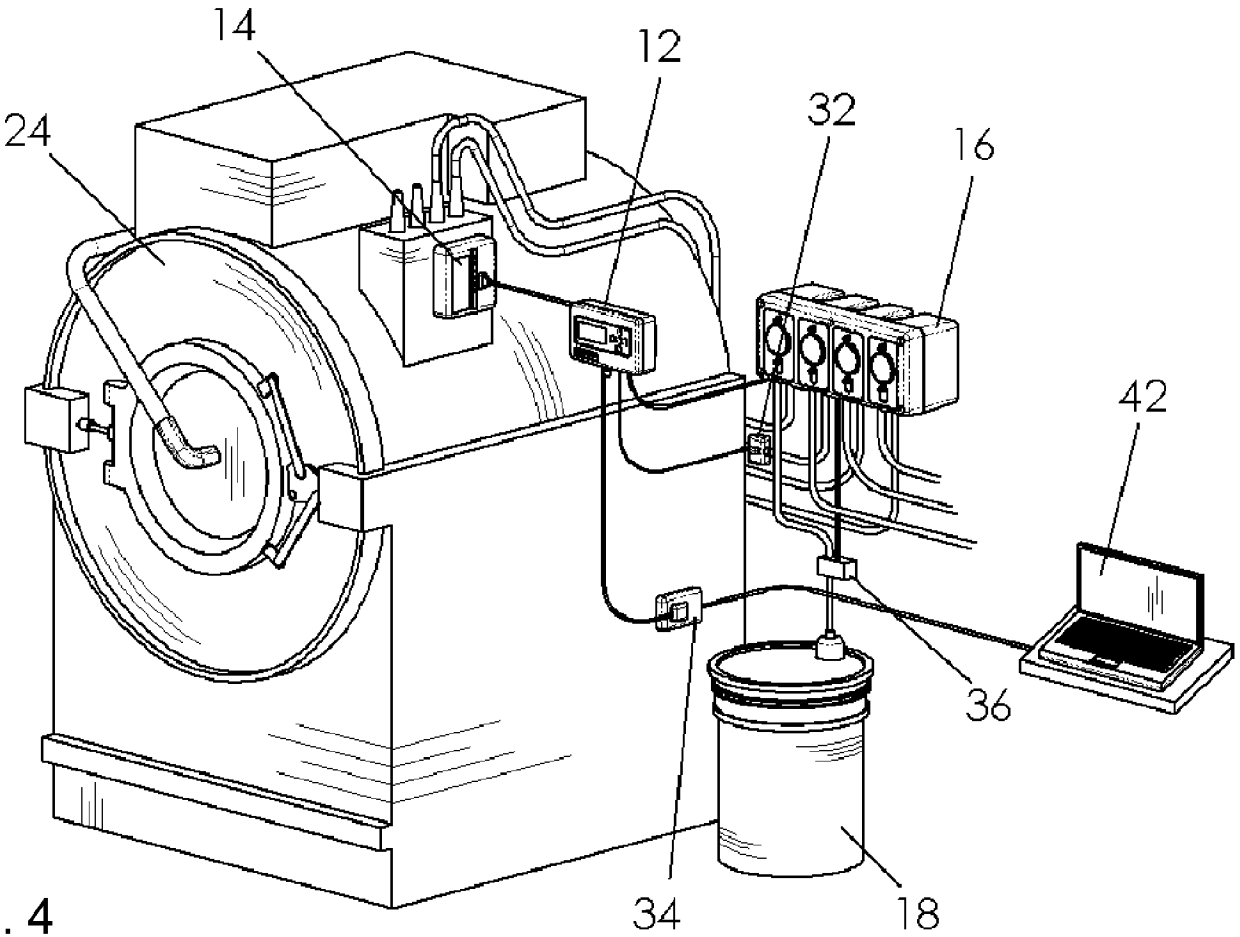
FIG. 4 illustrates of another one embodiment of the dispensing system of FIG. 2 with expanded capabilities of communication via computer.

As seen in FIG. 4, another expansion unit 31 may also include out of product alarm devices, which would connect between the micro-controller 12 or pump interface 16 and a chemical storage unit 18, for example, and be used to monitor the level of the chemical in the chemical storage unit 18 or the flow of chemical from the chemical storage unit 18. The monitor may then be configured to alert an operator or shut down the dispensing system 10 if the chemical level falls below a predetermined level, if the chemical is not flowing within the plumbing, or if it meets other configured conditions.

There are numerous interfaces that can be used to connect the expansion modules 30-36 to the micro-controller 12 of the dispensing system 10. In some embodiments, the micro-controller 12 may be configured with USB ports. In other embodiments, RS-485 ports may be used as an interface 26. Universal Serial Bus (USB) and RS-485 are examples of serial buses standard to interface devices. Both were designed to allow many peripherals to be connected using a single standardized interface socket and to improve the plug-and-play capabilities by allowing devices to be connected and disconnected without tearing down the system for a physical upgrade. Other convenient features include providing power to low-consumption devices without the need for an external power supply and allowing many devices to be used without requiring manufacturer specific, individual device drivers to be installed.

Embodiments of the micro-controller 12 may be configured with USB host functionality, allowing the micro-controller 12 to connect through the USB interface to other devices such as storage systems, network connections or other human interface devices. This type of connection may allow for data to be transferred to and from the micro-controller 12 and could be used, for example, for ease of set-up of the chemical dispensing system and its programming, field upgrades of system software, or data extraction for monitoring of the dispensing system 10.

Additionally, and as seen in FIG. 4, the serial interface may connect the micro-controller 12 to another computer 42 through an expansion module 34. The connection between the personal computer (PC) and the expansion module 34 may be through a hardwired or wireless connection, thus allowing the micro-controller 12 either local or remote communications with the PC 42 to receive and transmit data, instructions, new programming or the manipulation of data/information through the personal computer (PC).

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A chemical dispensing system for performing a base chemical dispensing operation and an upgraded chemical dispensing operation for a washing machine, the system comprising:

a micro-controller having a base chemical dispensing program file thereon and being operatively coupled to and configured to control a chemical dispenser of the chemical dispensing system, the chemical dispenser configured to dispense a chemical to the washing machine;

a single expansion module having an upgraded chemical dispensing program file thereon;

the micro-controller having a USB port;

the expansion module having a USB connector;

the micro-controller and the expansion module operably connected to one another via the USB port and connector;

the micro-controller configured to download chemical dispensing activity reports to the expansion module, and the micro-controller configured to upload the upgraded chemical dispensing program file from the expansion module, and the micro-controller configured to execute the upgraded chemical dispensing program file and to automatically configure aspects of the chemical dispensing system on the basis thereof in order to perform the upgraded chemical dispensing operation.

2. The chemical dispensing system of claim 1, wherein the expansion module is a data storage device.

3. The chemical dispensing system of claim 1, further comprising:

a computer in operable communication with the micro-controller, wherein data is transferred between the computer and the micro-controller.

4. The chemical dispensing system of claim 3, wherein the data is selected from a group consisting of: a chemical dispensing program, a single program parameter, activity reports, a single activity report, or combinations thereof.

5. The chemical dispensing system of claim 3, wherein the computer includes:

application software executing on the computer, wherein the application software generates data for automatically configuring the chemical dispensing system.

6. The chemical dispensing system of claim 1, further comprising:

a computer in communication with the micro-controller, wherein the micro-controller is reprogrammed using a local connection with the computer.

7. The chemical dispensing system of claim 1, further comprising:

a computer in communication with the micro-controller, wherein the micro-controller is reprogrammed through a remote connection with the computer.

8. The chemical dispensing system of claim 1, wherein the expansion module provides wireless communication to a machine interface, a pump interface, a machine, additional expansion modules, a computer, or a computer network.

9. The chemical dispensing system of claim 1, wherein the USB port includes a standard USB connection.

10. The chemical dispensing system of claim 1, wherein the USB port includes a mini-USB connection.

11. The chemical dispensing system of claim 1 wherein the upgraded chemical dispensing program file is an updated chemical dispensing program file configured to perform an updated chemical dispensing operation.

12. The chemical dispensing system of claim 1 wherein the upgraded chemical dispensing program file is an expanded chemical dispensing program file configured to perform an expanded chemical dispensing operation.

13. The chemical dispensing system of claim 1 wherein the upgraded chemical dispensing program file is both an updated chemical dispensing program file and an expanded chemical dispensing program file configured to perform an updated and expanded chemical dispensing operation.

14. A method for controlling a chemical dispensing system for performing a base chemical dispensing operation and an upgraded chemical dispensing operation in a washing machine, the method comprising:

providing a micro-controller having a base chemical dispensing program file thereon and being operatively coupled to and configured to control a chemical dispenser of the chemical dispensing system, the micro-controller having a USB port;

providing a single expansion module having an upgraded chemical dispensing program file thereon, the expansion module having a USB connector;

connecting the micro-controller and the single expansion module to one another via the USB port and connector;

downloading, by the micro-controller, chemical dispensing activity reports to the expansion module;

uploading, by the micro-controller, an upgraded chemical dispensing program file from the expansion module; and executing, by the micro-controller, the upgraded chemical dispensing program file to automatically configure aspects of the chemical dispensing system on the basis thereof in order to perform the upgraded chemical dispensing operation.

15. The method of claim 14, further comprising:

providing wireless communication by the expansion module to a machine interface, a pump interface, a machine, additional expansion modules, a computer, or a computer network.

16. A chemical dispensing system for a washing machine, the system having a plurality of operating modes including a base chemical dispensing operating mode and an upgraded chemical dispensing operating mode, the system comprising:

a control means operably connected to the system and providing a first operating mode of the chemical dispensing system, the first operating mode including providing the base chemical dispensing operation to the washing machine; and a single expansion means in operative communication with the control means and operably providing a second operating mode including providing the upgraded chemical dispensing operation to the chemical dispensing system;

the control means communicating with the expansion means through a USB connection to download chemical dispensing activity reports to the expansion means;

the control means further communicating with the expansion means to upload an upgraded chemical dispensing program file from the expansion means, and the control means executing the upgraded chemical dispensing program file to automatically configure aspects of the chemical dispensing system on the basis thereof in order to provide the second operating mode.

17. The chemical dispensing system of claim 16, wherein the second operating mode includes operations of the first operating mode and at least one additional operation.

18. The chemical dispensing system of claim 16, wherein the expansion means provides data storage.

19. The chemical dispensing system of claim 16, wherein the control means downloads chemical dispensing program file to the expansion means.

20. The chemical dispensing system of claim 16, wherein the USB port includes a standard USB connection.

21. The chemical dispensing system of claim 16, wherein the USB port includes a mini-USB connection.

22. A chemical dispensing system for a washing machine, the system comprising:

a machine interface operatively coupleable to the washing machine;

a pump interface configured to dispense a chemical to the washing machine;

a micro-controller operably coupled to the machine interface and the pump interface, the micro-controller having a base mode of operation that causes the pump interface to dispense the chemical according to the base mode of operation in response to signals received from the machine interface;

a single expansion module having an upgraded chemical dispensing program file thereon;

the micro-controller operatively coupled to a USB port;

the expansion module operatively coupled to a USB connector;

the expansion module in operable communication with the micro-controller via the USB port and connector;

the micro-controller configured to download chemical dispensing activity reports to the expansion module;

the micro-controller configured to upload the upgraded chemical dispensing program file from the expansion module, and the micro-controller configured to execute the upgraded chemical dispensing program file and to automatically configure aspects of the chemical dispensing system on the basis thereof in order to perform an upgraded chemical dispensing operation.

23. The system of claim 22, further comprising:

a chemical storage unit containing the chemical; and the washing machine, wherein the pump interface fluidically couples the washing machine to the chemical in the chemical storage unit and causes a desired amount of the chemical to be dispensed to the washing machine in response to a signal from the micro-controller.

24. The system of claim 23, wherein the machine interface is operatively coupled to the washing machine to receive signals from the washing machine, and in response to the signals from the washing machine, sends signals to the micro-controller indicative of an operational state of the washing machine.

* * * * *